US006448882B1

(12) United States Patent
Inaba et al.

(10) Patent No.: US 6,448,882 B1
(45) Date of Patent: Sep. 10, 2002

(54) LARGE CURRENT FUSE

(75) Inventors: Shigemitsu Inaba; Norio Matsumura; Mitsuhiko Totsuka; Yasuko Hibayashi, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 149 days.

(21) Appl. No.: 09/678,107

(22) Filed: Oct. 4, 2000

(30) Foreign Application Priority Data

Oct. 5, 1999 (JP) ..... 11-284017

(51) Int. Cl.[7] ..... H01H 85/143; H01H 85/175; H01R 13/68

(52) U.S. Cl. ..... 337/227; 337/166; 337/159; 337/186; 439/622; 439/893

(58) Field of Search ..... 337/186, 227, 337/228, 231, 246, 248, 252; 29/623; 439/621, 622, 893

(56) References Cited

U.S. PATENT DOCUMENTS

| | | | | | |
|---|---|---|---|---|---|
| 3,810,063 | A | * | 5/1974 | Blewitt | 337/159 |
| 4,504,816 | A | * | 3/1985 | Viola et al. | 337/255 |
| 4,837,546 | A | * | 6/1989 | Bernstein | 337/201 |
| 5,229,739 | A | | 7/1993 | Oh et al. | 337/290 |
| 5,293,147 | A | * | 3/1994 | Oh et al. | 337/201 |
| 5,854,583 | A | * | 12/1998 | Falchetti | 337/159 |
| 6,067,004 | A | * | 5/2000 | Hibayashi et al. | 337/186 |
| 6,294,978 | B1 | * | 9/2001 | Endo et al. | 337/159 |

FOREIGN PATENT DOCUMENTS

| | | | | |
|---|---|---|---|---|
| DE | 1 865 576 | | 1/1963 | |
| DE | 1 463 125 | | 9/1964 | |
| DE | 199 01 637 | | 7/1999 | |
| DE | 199 47 137 | | 4/2000 | |
| FR | 1.122.638 | | 9/1956 | |
| JP | 61-66387 | | 4/1986 | |
| JP | 2637846 | | 4/1997 | |
| JP | 11-250790 A | * | 9/1999 | H01H/37/76 |
| WO | WO 88/01790 | | 3/1988 | |

OTHER PUBLICATIONS

Copy of European Patent Office Communication including European Search Report for corresponding European Patent Application No. 00121787 dated Jan. 25, 2002.

* cited by examiner

*Primary Examiner*—Anatoly Vortman
(74) *Attorney, Agent, or Firm*—Armstrong, Westerman & Hattori, LLP

(57) ABSTRACT

A large current fuse 21 which comprises a metallic fusing member 22 and a resin housing 23, the metallic fusing member 22 including a first conductive plate 25, a second conductive plate 26, and a fusing part 27, the resin housing 23 having an open space 49 through which the fusing part is exposed, the first conductive plate 25 being provided at its side face with a first projecting piece 31 projecting by way of an edge of the open space 49, the second conductive plate 26 being provided at its side face with the second projecting piece 37 projecting by way of the edge of the open space 49, a width D1 of the first projecting piece 31 in a direction perpendicular to its projecting direction and a width D2 of the second projecting piece 37 in a direction perpendicular to its projecting direction being of a fixed size, irrespective of the rated current. The large current fuse which does not require the respective molding dies exclusively according to the rated currents is provided.

5 Claims, 6 Drawing Sheets

LARGE CURRENT FUSE

BACKGROUND OF THE INVENTION

1. Field of the Invention

The present invention relates to a large current fuse which is employed in a vehicle such as an automobile.

2. Description of the Related Art

A large current fuse as disclosed in Japanese Patent Publication No. 2637846 has been widely known as a conventional large current fuse of this type.

A structure of the large current fuse disclosed in the Japanese Patent Publication will be briefly described hereunder referring to FIGS. 10 and 11.

In FIG. 10, the large current fuse 1 comprises a metallic fusing member 2 and a pair of resin covers 3, 3. The metallic fusing member 2 is integrally formed of a metal plate having electric conductivity, and electrically connected and fixed to a connecting part of a mating component (not shown) by means of stud bolts 4 and nuts 5. The resin covers 3, 3 are overlapped on the metallic fusing member 2 from a front and a back sides of the metallic fusing member 2, and bonded by ultrasonic welding.

In FIG. 11, the metallic fusing member 2 includes a first conductive plate 6, a second conductive plate 7, and a fusing part 8. The first conductive plate 6 and the second conductive plate 7 are respectively provided with mounting holes 9 having a large diameter and welding pin holes 10, 10 having a small diameter.

The fusing part 8 is formed in an S-shape between the first conductive plate 6 and the second conductive plate 7 with its opposite ends connected to the first conductive plate 6 and the second conductive plate 7. A fusible member 11 is disposed in the middle of the fusing part 8.

The resin cover 3 is so designed as to extend over the first conductive plate 6 and the second conductive plate 7 and to be higher at its central part in a side elevational view. The resin cover 3 includes fixing parts 12, 12 to be fixed to the first conductive plate 6 and the second conductive plate 7, a part 13 forming a space for containing the fusing part 8, a longitudinally extending rib 14, and a guide 15 corresponding to the rib 14.

The fixing parts 12, 12 are respectively provided with welding pins 16 and holes 17 for receiving the pins 16.

The part 13 is formed between the fixing parts 12, 12 continuing therefrom and defines the space for containing the fusing part 8. A recess 18 is formed in the space defining the part 13 on a side facing with the fusing part 8.

It is to be noted that the resin covers 3, 3 can be commonly used even in case where the fusing part 8 is modified to any shape having electric resistance value corresponding to the rated current.

In the prior art as described hereinabove, a welding assembling machine has been additionally required for assembling the resin covers 3, 3, and a cost for installing the welding assembling machine has been a factor of high cost.

Moreover, since the metallic fusing member:2 and the resin covers 3, 3 are not integrally formed in a strict sense, sufficient rigidity cannot be obtained. When a torsion force is applied to the large current fuse 1, the metallic fusing member 2 is likely to be deformed in a torsion direction. The large current fuse 1 has been of such a structure as being easily influenced by environments.

As a countermeasure, it has been considered that the resin covers 3, 3 of synthetic resin are integrally formed with the metallic fusing member 2, in view of assembling steps of the resin covers 3, 3 to the metallic fusing member 2 and number of steps for molding the resin covers 3, 3.

However, because a width D of the fusing part 8 at areas continuing to the first conductive plate 6 and the second conductive plate 7 is variable according to the rated currents, a molding die exclusive for each of the rated currents has been necessary in order to secure the space for containing the fusing part 8. Therefore, this has not been a perfect countermeasure.

Meanwhile, as apparent from the described. structure, the resin covers 3, 3 are not so constructed that a state of the fusing part 8 can be visually observed, and heat generating in the metallic fusing member 2 cannot be completely radiated.

The present invention has been made to overcome the above described problems, and it is an object of the invention to provide a large current fuse which does not require exclusive molding dies for molding respective resin housings according to the rated currents. A large current fuse in which a state of a fusing part can be visually observed and having high radiation efficiency is provided at the same time.

SUMMARY OF THE INVENTION

According to the invention, there is provided a large current fuse which comprises a metallic fusing member integrally formed of a metal plate having electric conductivity, a resin housing formed of synthetic resin and integrally molded with the metallic fusing member, the metallic fusing member including a first conductive plate formed in such a shape as corresponding to an electrically connecting part of a mating component, a second conductive plate formed in such a shape as corresponding to another electrically connecting part and spaced from the first conductive plate, and a fusing part positioned between the first conductive plate and the second conductive plate, formed in such a shape as having electric resistance value according to a rated current, and adapted to be fused by an over current thereby to open a circuit, the resin housing being formed extending from a front face to a back face of the first conductive plate, from a front face to a back face of the second conductive plate, and between the first and second conductive plates, and having an open space through which the fusing part is exposed, a first projecting piece continuing to the fusing part being formed on a side face which is a thickness of the first conductive plate facing with the second conductive plate, the first projecting piece projecting toward the second conductive plate by way of an edge defining the open space, a second projecting piece continuing to the fusing part being formed on a side face which is a thickness of the second conductive plate facing with the first conductive plate, the second projecting piece projecting toward the first conductive plate by way of the edge, a width of the first projecting piece in a direction perpendicular to its projecting direction and a width of the second projecting piece in a direction perpendicular to its projecting direction being of a fixed size, irrespective of the rated current.

According to a second aspect of the invention, at least one of the first projecting piece and the second projecting piece is provided with an opening passing from a front face to a back face thereof.

According to a third aspect of the invention, the width of the first projecting piece and the width of the second projecting piece are broader than portions of the fusing part continuing from the first projecting piece and the second projecting piece.

According to a fourth aspect of the invention, at least one small hole passing from the front face to the back face is respectively provided at areas of the first conductive plate and the second conductive plate on which the resin housing is molded.

According to a fifth aspect of the invention, a plurality of fins are formed on the resin housing at least at areas on which the resin housing is molded on the first conductive plate and the second conductive plate.

According to the invention, there is provided the large current fuse consisting of the metallic fusing member and the resin housing integrally formed therewith.

Because the resin housing is formed extending from the front face to the back face of the first conductive plate, from the front face to the back face of the second conductive plate, and between the first and second conductive plates, the resin housing will not be deformed by an outer force or environmental condition.

Further, because the resin housing has the open space through which the fusing part is exposed, the fusing part can be visually observed.

The first conductive plate is provided with the first projecting piece having a fixed width and the second conductive plate is provided with the second projecting piece having a fixed width. Accordingly, the molding die of the resin housing will not be influenced by the shape of the fusing part, and there is no need of providing the molding dies exclusively for respective rated currents.

According to the second aspect, the structure is useful in setting the electric resistance value of the fusing part according to the rated current. Moreover, a difference in expansion and contraction by heat between the resin and the metal can be absorbed by the opening.

According to the third aspect, the first and the second conductive plate can be utilized as heat radiation plates.

According to the fourth aspect, the synthetic resin flows into the small holes passing from the front face to the back face, and the resin housing will be strengthened.

According to the fifth aspect, by providing a plurality of the fins, the radiation efficiency will be improved as compared with the conventional large current fuse.

DESCRIPTION OF THE PREFERRED EMBODIMENTS

Now, one embodiment of the present invention will be described referring to the attached drawings.

Figure 1:
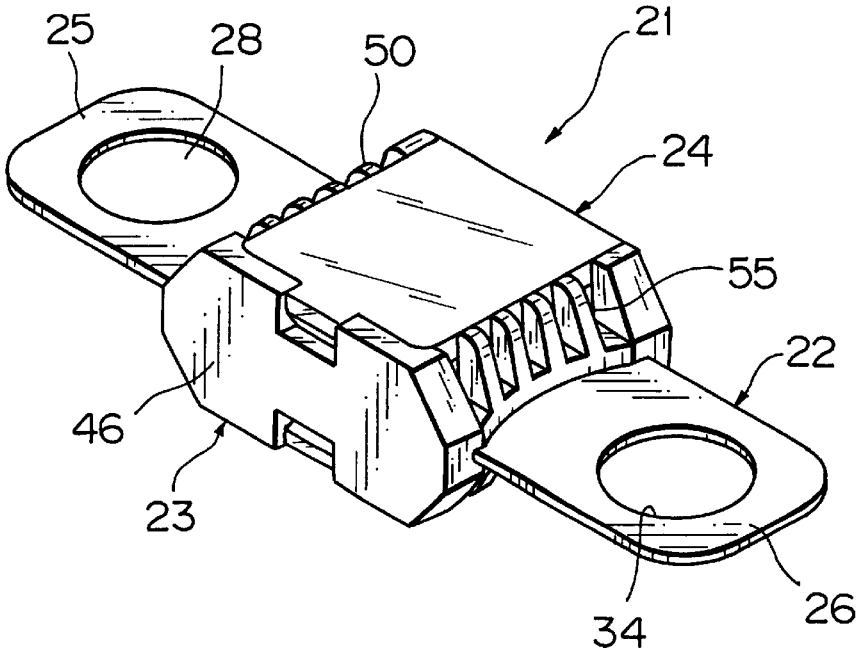
FIG. 1 is a perspective view showing an embodiment of a large current fuse according to the present invention.
Figure 3:
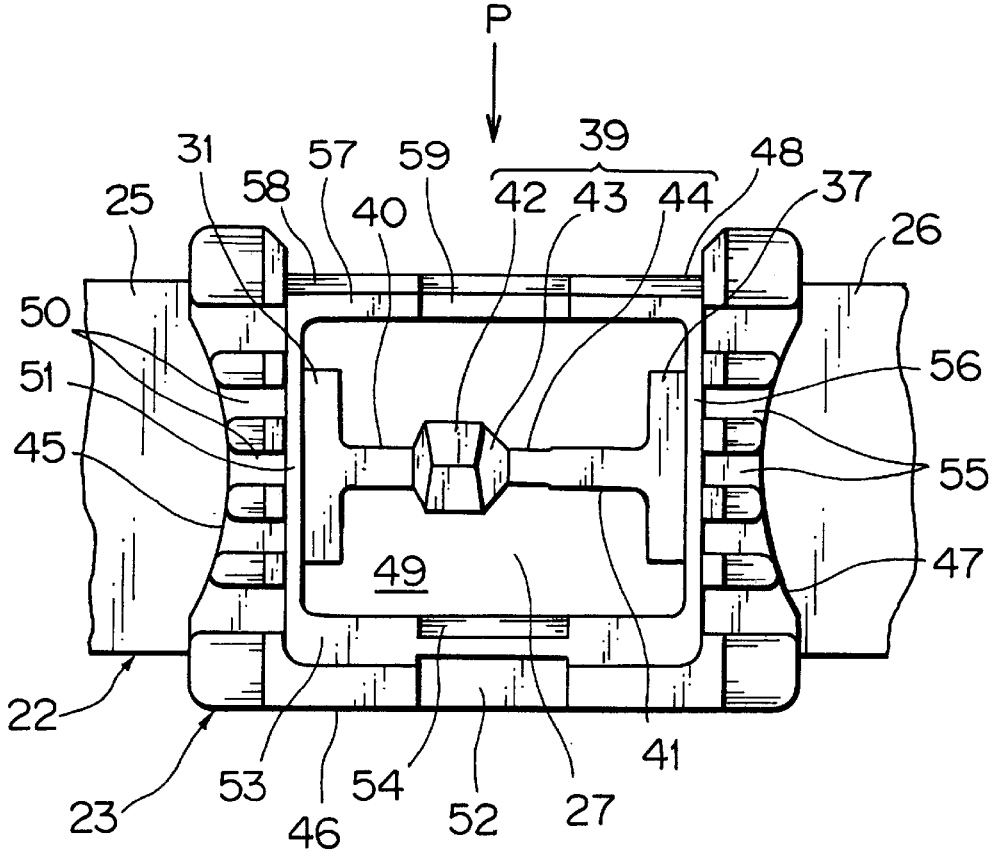
FIG. 3 is a plan view of a resin housing of FIG. 1.
Figure 2:
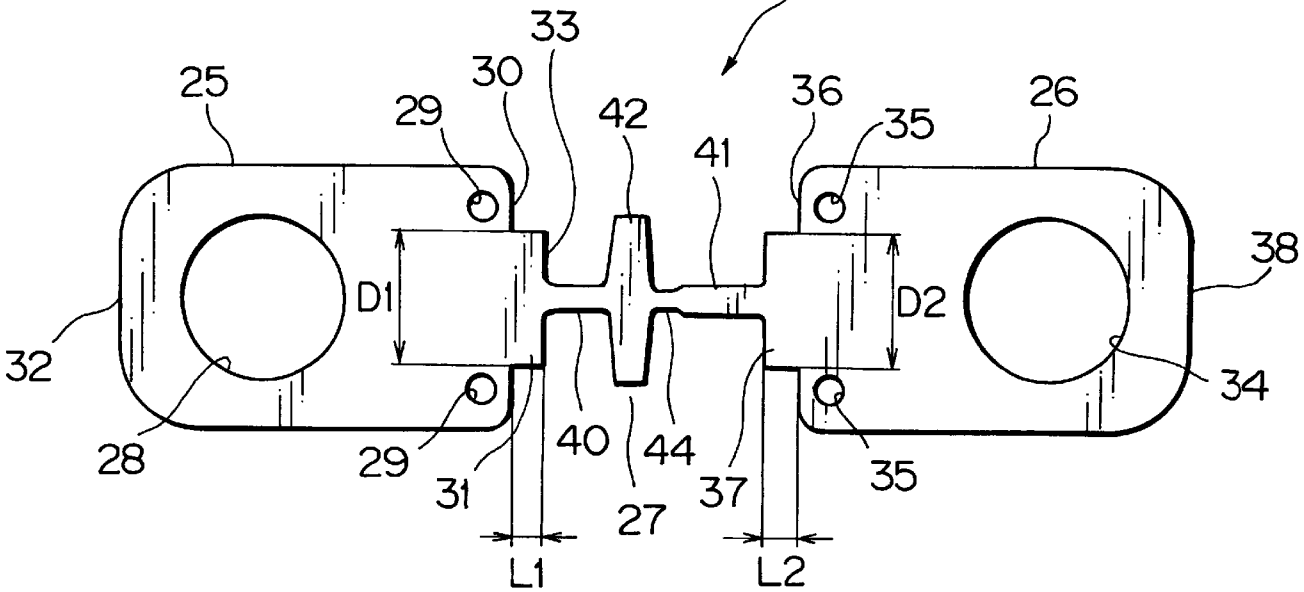
FIG. 2 is a plan view of a metallic fusing member of FIG. 1.
Figure 4:
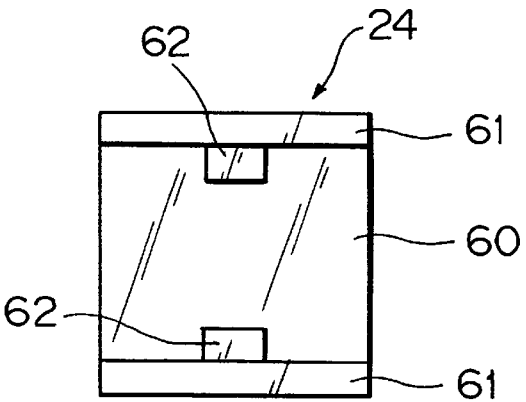
FIG. 4 is a front view of a transparent cover of FIG. 1.
Figure 5:
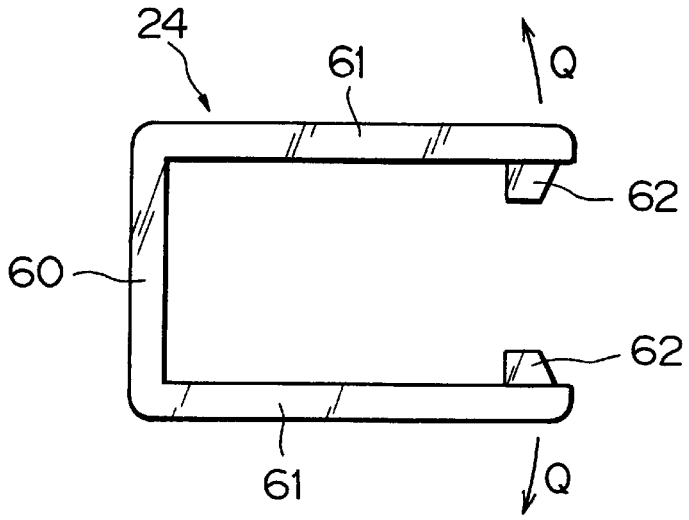
FIG. 5 is a side view of the transparent cover of FIG. 1.
Figure 6:
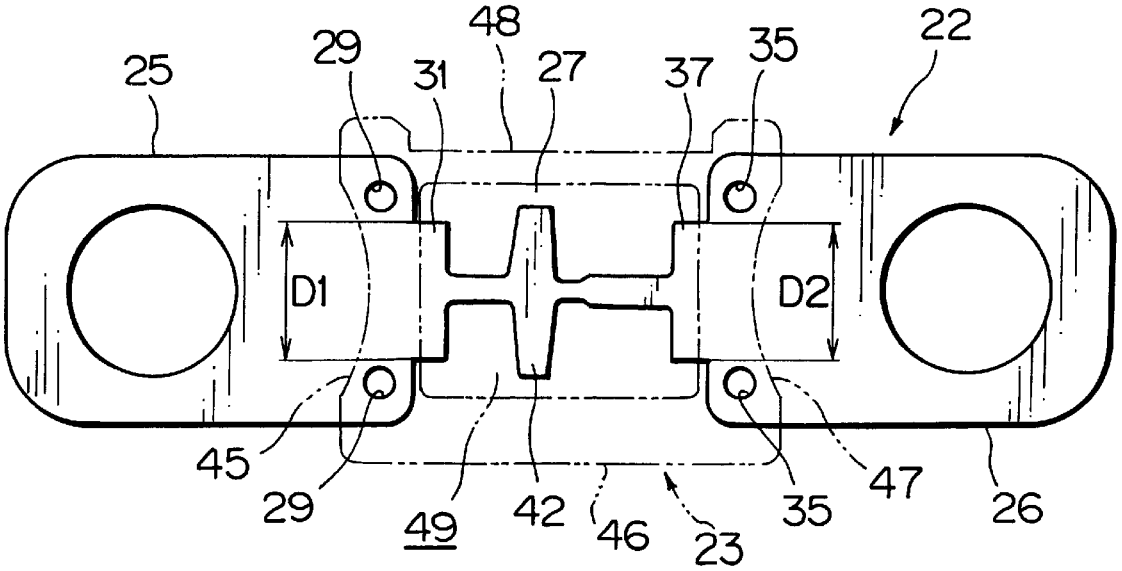
FIG. 6 is an explanatory view showing molding process of the resin housing.

FIG. 1 is a perspective view showing an embodiment of a large current fuse according to the present invention, FIG. 2 is a plan view of a metallic fusing member of FIG. 1, FIG. 3 is a plan view of a resin housing of FIG. 1, FIG. 4 is a front view of a transparent cover of FIG. 1, FIG. 5 is a side view of the transparent cover of FIG. 1, and FIG. 6 is an explanatory view showing molding process of the resin housing.

In FIG. 1, reference numeral 21 represents a large current fuse adapted to be directly or indirectly connected to a starter motor, alternator, battery, etc. in a vehicle such as an automobile.

The large current fuse 21 includes a metallic fusing member 22, a resin housing 23 integrally formed with the metallic fusing member 22, and a transparent cover 24 mounted on the resin housing 23.

The components will be described hereunder in detail.

The metallic fusing member 22 is integrally formed of a metal plate having conductivity by stamping, and as shown in FIG. 2, includes a first conductive plate 25, a second conductive plate 26, and a fusing part 27.

The first conductive plate 25 is in such a shape as corresponding to an electrically connecting part of a mating component (not shown). Although the first conductive plate 25 is in a substantially rectangular shape in a plan view in this embodiment, it may be in a partially folded form for example at 90 degree. Alternatively, it may be formed in an L-shape on a same plane.

The first conductive plate 25 is provided with an assembling hole 28 having a large diameter, and small holes 29, 29 whose diameter is sufficiently smaller than that of the assembling hole 28. On an end face 30 of the first conductive plate 25 facing with the second conductive plate 26, is formed a first projecting piece 31 so as to project toward the second conductive plate 26.

The end face 30 is a part of a side face composed of a thickness of the first conductive plate 25.

The assembling hole 28 is a through hole for passing through a stud bolt (not shown) of the aforesaid mating component to which a nut (not shown) is adapted to be screwed. The assembling hole 28 is provided on a center axis of the first conductive plate 25 adjacent to an end face 32 opposite to the end face 30.

The small holes 29, 29 are through holes which are provided adjacent to the end face 30 passing through the front and back faces of the first conductive plate 25. The small holes 29, 29 are formed along the end face 30 in this embodiment. By providing at least one small hole 29, rigidity of the resin housing 23 (See FIG. 1) can be increased as will be described hereinbelow.

The first projecting piece 31 of a rectangular shape in a plan view is arranged on a same plane as the first conductive plate 25 continuing from the end face 30. The first projecting piece 31 is symmetrically formed with respect to the aforesaid center axis.

A width D1 of the first projecting piece 31 which is perpendicular to the center axis and in parallel to the front and back faces of the first conductive plate 25 is fixed irrespective of the rated current of the large current fuse 21. A length L1 between the end face 30 and an end face 33 of the first projecting piece 31 is variable, because the length L1 is appropriately determined according to the electrical resistance value of the fusing part 27.

The second conductive plate 26 has the same shape as the first conductive plate 25 and arranged symmetrically with the first conductive plate 25 with respect to a rotation center.

The second conductive plate 26 is in a form corresponding to an electrically connecting part of a mating component (not shown), which is different from the mating component of the first conductive plate 25. Although the second conductive plate 26 is in a substantially rectangular shape in a plan view in this embodiment, it may be in a partially folded form for example at 90 degree. Alternatively, it may be formed in an L-shape on a same plane.

The second conductive plate 26 is provided with an assembling hole 34 having a large diameter, and small holes 35, 35 whose diameter is sufficiently smaller than that of the assembling hole 34. On an end face 36 of the second conductive plate 26 facing with the first conductive plate 25, is formed a second projecting piece 37 so as to project toward the first conductive plate 25. The end face 36 is defined in the same manner as the end face 30.

The assembling hole 34 is a through hole for passing through a stud bolt (not shown) of the aforesaid mating component to which a nut (not shown) is adapted to be screwed. The assembling hole 34 is provided on a center axis of the second conductive plate 26 adjacent to an end face 38 opposite to the end face 36.

The small holes 35, 35 are through holes which are provided adjacent to the end face 36 passing through the front and back faces of the second conductive plate 26. The small holes 35, 35 are formed along the end face 36 in this embodiment. By providing at least one small hole 35, rigidity of the resin housing 23 (FIG. 1) can be increased as will be described hereinbelow.

The second projecting piece 37 of a rectangular shape in a plan view is arranged on the same plane as the second conductive plate 26 continuing from the end face 36. The second projecting piece 37 is symmetrically formed with respect to the aforesaid center axis.

A width D2 of the second projecting piece 37 which is perpendicular to the center axis and in parallel to the front and back faces of the second conductive plate 26 is fixed irrespective of the rated current of the large current fuse 21. The width D2 is equal to the width D1 in this embodiment.

A length L2 between the end face 36 and an end face of the second projecting piece 37 is variable as well as the length L1, because the length L2 is appropriately determined according to the electrical resistance value of the fusing part 27.

The fusing part 27 has a fusible member 39 and continuing portions 40, 41 which are continuingly formed on both sides of the fusible member 39 as seen in FIG. 3.

The fusible member 39 is adapted to be fused by an over current to open the circuit, and consists of a caulking piece 42, a tin tip 43 to be caulked with the caulking piece 42, and a neck portion 44.

The caulking piece 42 continues from an end of the continuing portion 40, and extends in a direction perpendicular to the aforesaid center axis at both sides of the continuing portion 40. The caulking piece 42 is caulked so as to embrace the tin tip 43 as shown in FIG. 3.

The neck portion 44 continues to the caulking piece 42 at its one end and continues to an end of the continuing portion 41 at the other end. The neck portion 44 is formed narrower than the continuing portion 41.

The continuing portion 40 continues to the caulking piece 42 at its one end and continues to the end face 33 of the first projecting piece 31 at the other end. The other end of the continuing portion 41 continues to an end face of the second projecting piece 37. Both the continuing portions 40, 41 are located on the aforesaid center axis.

The continuing portions 40, 41 are formed narrower than the first and the second projecting pieces 31, 37, thus enabling the first and the second projecting pieces 31, 37 to exert heat radiation effect.

The above mentioned resin housing 23 is a frame-like member of a substantially rectangular shape formed of synthetic resin and integrally formed with the metallic fusing member 22. As shown in FIG. 3, the resin housing 23 includes a first to fourth reinforcing walls 45–48. The first to the fourth reinforcing walls 45–48 define an open space 49 through which the fusing part 27 is exposed. The first reinforcing wall 45 and the third reinforcing wall 47 are of the same shape, and symmetrically arranged.

The first reinforcing wall 45 is formed so as to extend from the front face to the back face of the first conductive plate 25. The first reinforcing wall 45 is provided with a plurality of (four in this embodiment, but not limited to this number) fins 50 on each of its front face and back face. Receiving portions 51 for the transparent cover 24 are formed on the front and back faces at a side of the open space 49.

The fins 50 are formed in back and forth directions and function so that heat generated in the first conductive plate 25 and so on can be efficiently radiated to the exterior.

The second reinforcing wall 46 is formed so as to override the first conductive plate 25 and the second conductive plate 26 in such a manner that it extends from the front faces to the back faces of the first conductive plate 25 and the second conductive plate 26.

The second reinforcing wall 46 is provided with locking portions 52 in the middle of its upper and lower end faces. Receiving portions 53 for the transparent cover 24 are formed on the front and back faces at a side of the open space 49. A bottom of the locking portion 52 is located below the receiving portion 53. The receiving portion 53 continues to the receiving portion 51 and is provided with a slightly inclined face 54 at a position corresponding to the locking portion 52.

The third reinforcing wall 47 is formed so as to extend from the front face to the back face of the second conductive plate 26. The third reinforcing wall 47 is provided with a plurality of (four in this embodiment, but not limited to this number) fins 55 on each of its front face and back face. Receiving portions 56 for the transparent cover 24 are formed on the front and back faces at a side of the open space 49.

The fins 55 are formed in back and forth directions and function so that heat generated in the second conductive plate 26 and so on can be efficiently radiated to the exterior.

The fourth reinforcing wall 48 is formed so as to override the first conductive plate 25 and the second conductive plate 26 in such a manner that it extends from the front faces to the back faces of the first conductive plate 25 and the second conductive plate 26.

Upper and lower end faces 57 of the fourth reinforcing wall 48 correspond to the receiving portions 51, 53, and are provided with inclined walls 58 outside. Guide portions 59 for guiding the transparent cover 24 are formed on the end faces 57 and the inclined walls 58.

Looking into the open space 49, the first projecting piece 31 and the second projecting piece 37 project from the first reinforcing wall 45 and the third reinforcing wall 47. The first projecting piece 31 and the second projecting piece 37 project in directions of approaching to each other from edges defining the open space 49. The fusing part 27 is continuingly formed between the first projecting piece 31 and the second projecting piece 37. The fusing part 27 in case of a rated current of 40A, for example, is shown in FIG. 3.

The transparent cover 24 is molded of transparent synthetic resin, and consists of a base wall 60, and a pair of flexible walls 61, 61 integrally formed at both ends of the base wall 60 as shown in FIGS. 4 and 5. The transparent cover 24 is adapted to be mounted on the resin housing 23 in a direction of an arrow P in FIG. 3.

The base wall 60 is in a rectangular shape and adapted to face with the fourth reinforcing wall 48. The flexible walls 61, 61 are deformed in directions of arrows Q in FIG. 5, when the transparent cover 24 is mounted on the resin housing 23. At free ends of the flexible walls 61, 61, are formed engaging projections 62, 62 so as to face with each other. The engaging projections 62, 62 are adapted to engage with the locking portions 52 which are provided on the second reinforcing wall 46 (See FIG. 3).

Because of transparency of the transparent cover 24, the fusing part 27 exposed through the open space 49 (See FIG. 3) can be visually observed even when the transparent cover 24 has been mounted on the resin housing 23.

Referring now to FIG. 6, molding steps of the resin housing 23 will be briefly explained.

After the metallic fusing member 22 has been produced, the metallic fusing member 22 is set in a molding die (not shown) to integrally mold the resin housing 23 at a position indicated by a phantom line.

The molding die is constructed to be opened in both back and front directions. Because the width D1 of the first projecting piece 31 and the width D2 of the second projecting piece 37 are fixed, the structure of the molding die at an area forming the open space 49 is such that by providing relieves corresponding to the widths D1 and D2, molding can be conducted without creating a flow of the resin into the open space 49.

Therefore, the molding will not be influenced by the shape of the fusing part 27. The resin housings for large current fuses having different rated currents can be integrally molded with a single molding die as described above but not shown.

When the resin housing 23 is integrally molded, the synthetic resin flows into the small holes 29, 29 and 35, 35, thus strengthening the resin housing 23.

As described herein referring to FIGS. 1 through 6, the large current fuse 21 has the structure wherein the resin housing 23 is integrally molded with the metallic fusing member 22. Therefore, the resin housing 23 will not be easily deformed by an outer force or an environmental condition. Because of the open space 49 provided in the resin housing 23, the fusing part 27 can be visually observed, even though the transparent cover 24 has been mounted.

On occasion of forming the open space 49 in the resin housing 23, because the first projecting piece 31 having the fixed width is formed on the first conductive plate 25 and the second projecting piece 37 having the fixed width is formed on the second conductive plate 26, the molding die for the resin housing 23 will not be influenced by the shape of the fusing part 27.

Figure 11:
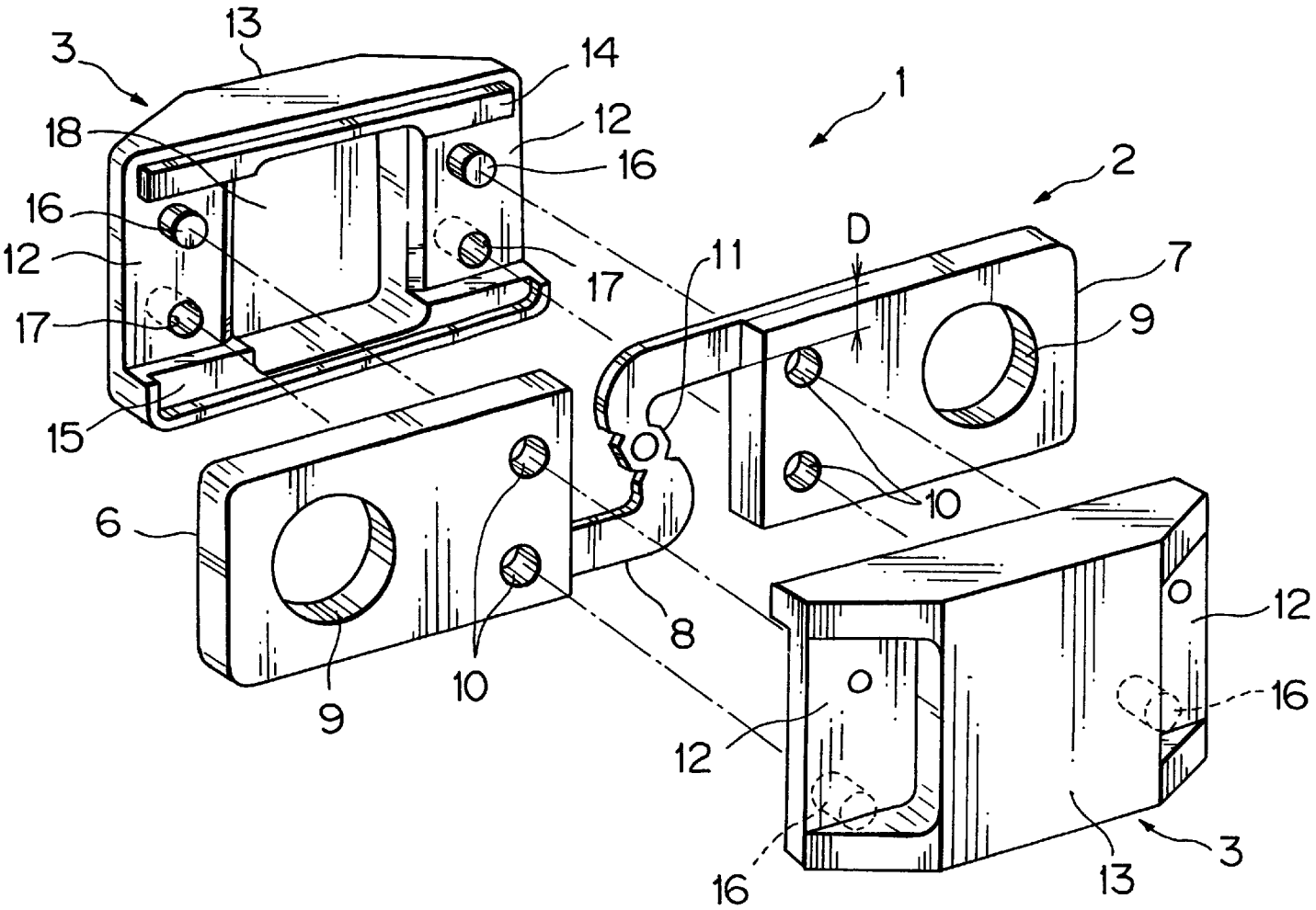
FIG. 11 PRIOR ART
FIG. 11 is an exploded perspective view of FIG. 10.

Integrally molding the resin housing 23 with the metallic fusing member 22 will reduce the working steps in number as compared with the conventional assembling steps of the resin covers 3, 3 to the metallic fusing member 2 as shown in FIG. 11 and the conventional molding steps of the resin covers 3, 3. Moreover, the welding assembling machine conventionally employed will not be required.

From the foregoing, it is possible to provide the large current fuses which will not require exclusive molding dies for molding the resin housings for different rated currents.

Figure 7:
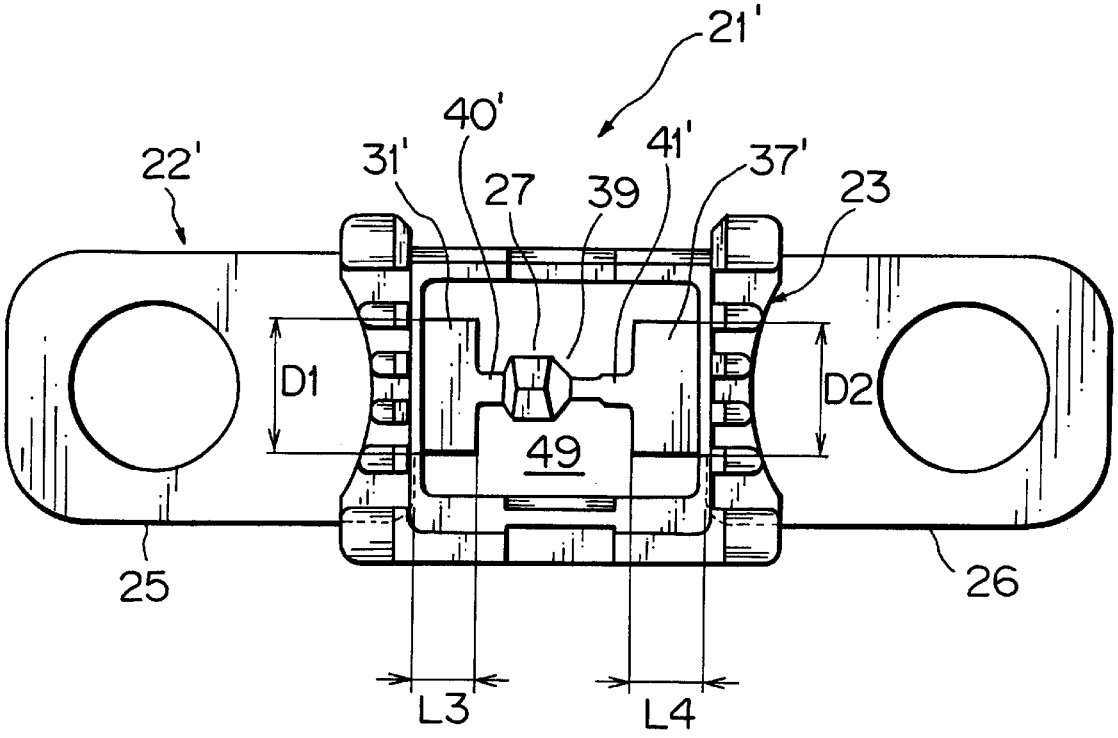
FIG. 7 is a plan view of a large current fuse having a rated current which is different from the one in FIG. 1 with the transparent cover omitted.

FIG. 7 is a plan view of a large current fuse in which the rated current is different from the one described in FIG. 1 with the transparent cover omitted.

In the above described large current fuse 21 in the embodiment of FIG. 1, the rated current is set to be 40 A, while in the large current fuse 21' in FIG. 7, the rated current is set to be 125 A, for example.

The large current fuse 21' consists of a metallic fusing member 22', the resin housing 23 and the transparent cover 24 (not shown in FIG. 7, but refer to FIG. 1). Those components which are essentially the same as the large current fuse 21 in FIG. 1 will be represented by the same reference numerals and their explanation will be omitted.

The metallic fusing member 22' includes the first conductive plate 25, the second conductive plate 26, and the fusing part 27. The first conductive plate 25 is formed with a first projecting piece 31' at the same position as the aforesaid first projecting piece 31 as shown in FIG. 3. The second conductive plate 26 is formed with a second projecting piece 37' at the same position as the aforesaid second projecting piece 37 as shown in FIG. 3.

A width of the first projecting piece 31' is also D1 which is the same as the first projecting piece 31 as shown in FIG. 2. A width of the second projecting piece 37' is also D2 which is the same as the second projecting piece 37 as shown in FIG. 2.

A length L3 of the first projecting piece 31' is larger than the length L1 of the first projecting piece 31 as shown in FIG. 2. A length L4 of the second projecting piece 37' is larger than the length L2 of the second projecting piece 37 as shown in FIG. 2.

The fusing part 27 has a fusible member 39 and continuing portions 40', 41' which are continuingly formed on both sides of the fusible member 39. The continuing portions 40', 41' are respectively shorter than the aforesaid continuing portions 40, 41 as shown in FIG. 2.

As described above, moldability of the resin housing 23 is not influenced even though the rated currents are different.

Figure 8:
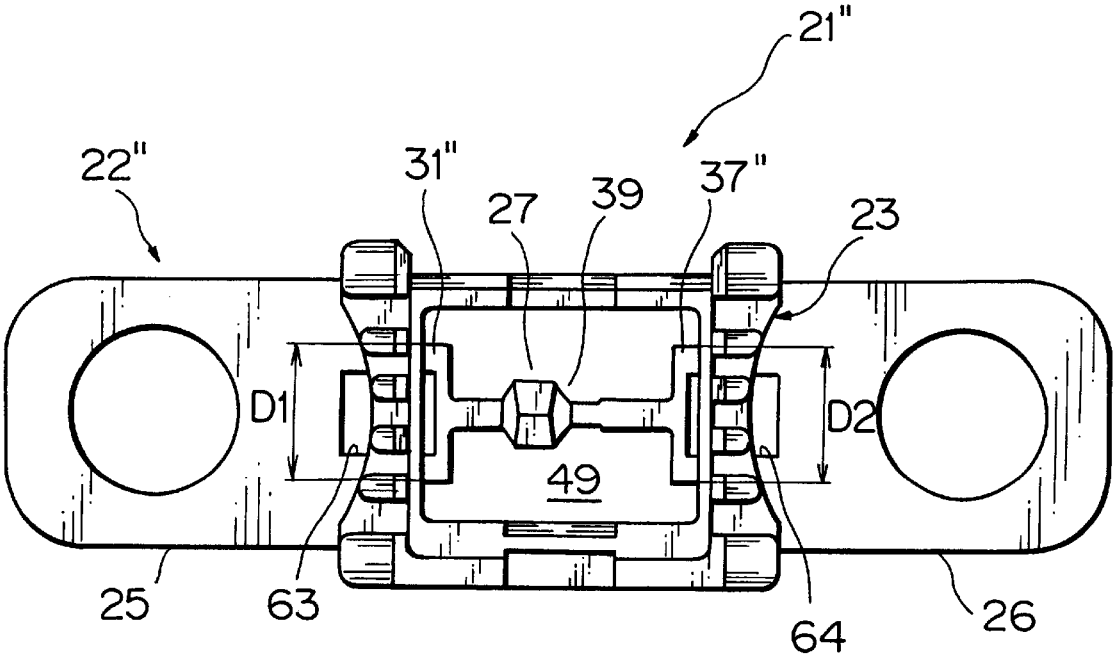
FIG. 8 is a plan view of a large current fuse having a rated current which is different from those in FIGS. 1 and 7 with the transparent cover omitted.
Figure 9:
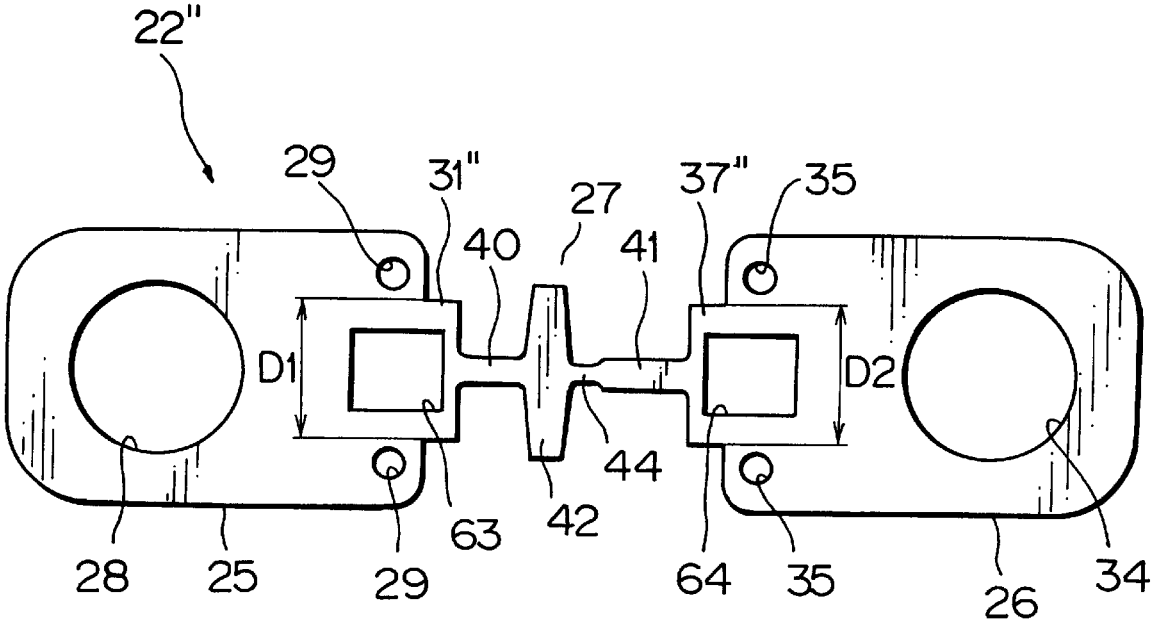
FIG. 9 is a plan view of the metallic fusing member of FIG. 8.
Figure 10:
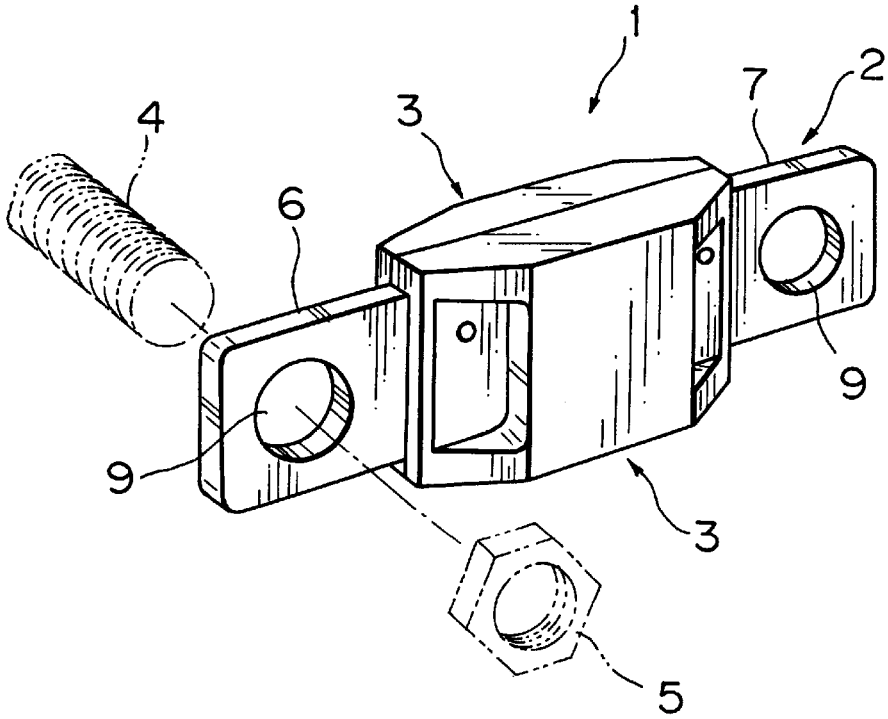
FIG. 10 PRIOR ART
FIG. 10 is a perspective view of a conventional large current fuse.

FIG. 8 is a plan view of a large current fuse in which the rated current is different from those described in FIGS. 1 and 7 with the transparent cover omitted. FIG. 9 is a plan view showing a metallic fusing member of FIG. 8.

In the above described large current fuse 21 in the embodiment of FIG. 1, the rated current is set to be 40A, while in a large current fuse 21" in FIG. 8, the rated current is set to be 60A, for example.

The large current fuse 21" consists of a metallic fusing member 22"the resin housing 23, and the transparent cover 24 (not shown in FIG. 7, but refer to FIG. 1). Those components which are essentially the same as the large current fuse 21 in FIG. 1 will be represented by the same reference numerals and their explanation will be omitted.

The metallic fusing member 22" includes the first conductive plate 25, the second conductive plate 26, and the fusing part 27 as shown in FIGS. 8 and 9. The first conductive plate 25 is formed with a first projecting piece 31" of the same shape at the same position as the aforesaid first projecting piece 31 as shown in FIG. 3. The second conductive plate 26 is formed with a second projecting piece 37" of the same shape at the same position as the aforesaid second projecting piece 37 as shown in FIG. 3.

A width of the first projecting piece 31" is also D1 which is the same as the first projecting piece 31 as shown in FIG. 2. A width of the second projecting piece 37" is also D2 which is the same as the second projecting piece 37 as shown in FIG. 2.

The first projecting piece 31" is provided with a rectangular opening 63 passing through the front and back faces of the first conductive plate 25. In this embodiment, the opening 63 is formed extending to the first conductive plate 25, but it is apparent that the opening 63 is formed within a projecting range of the first projecting piece 31". The opening 63 is not necessarily of a rectangular shape, but can be in any shape that is effective to vary the electric resistance value of the fusing part 27. The case is the same with the opening 64 which is similarly provided in the second projecting piece 37".

The first projecting piece 31" and the second projecting piece 37" projecting into the open space 49 through the openings 63, 64 are exposed in a frame-like shape. This enables the openings 63, 64 to absorb difference in expansion and contraction by heat between the resin and the metal.

Needless to say, the large current fuses 21' and 21" can attain the same effects as the aforesaid large current fuse 21.

Although the present invention has been fully described by way of examples referring to the accompanying drawings, it is to be noted that various changes and modifications will be apparent to those skilled in the art.

What is claimed is:

1. A large current fuse which comprises:

a metallic fusing member integrally formed of a metal plate having electric conductivity, and a resin housing formed of synthetic resin and integrally molded with said metallic fusing member, said metallic fusing member including;

a first conductive plate formed in such a shape as corresponding to an electrically connecting part of a mating component, a second conductive plate formed in such a shape as corresponding to another electrically connecting part and spaced from said first conductive plate, and a fusing part positioned between said first conductive plate and said second conductive plate, formed in such a shape as having electric resistance value according to a rated current, and adapted to be fused by an over current thereby to open a circuit, said resin housing being formed extending from a front face to a back face of said first conductive plate, from a front face to a back face of said second conductive plate, and between said first and second conductive plates, and having an open space through which said fusing part is exposed, a first projecting piece continuing to said fusing part being formed on a side face which is a thickness of said first conductive plate facing with said second conductive plate, said first projecting piece projecting toward said second conductive plate by way of an edge defining said open space, a second projecting piece continuing to said fusing part being formed on a side face which is a thickness of said second conductive plate facing with said first conductive plate, said second projecting piece projecting toward said first conductive plate by way of said edge, a width of said first projecting piece in a direction perpendicular to its projecting direction and a width of said second projectin piece in a direction perpendicular to its projecting direction being of a fixed size, irrespective of said rated current.

2. A large current fuse according to claim 1, wherein at least one of said first projecting piece and said second projecting piece is provided with an opening passing from a front face to a back face thereof.

3. A large current fuse according to claim 1 or 2, wherein said width of said first projecting piece and said width of said second projecting piece are broader than portions of said fusing part continuing from said first projecting piece and said second projecting piece.

4. A large current fuse according to any one of claims 1 or 2, wherein at least one small hole passing from said front face to said back face is respectively provided at areas of said first conductive plate and said second conductive plate on which said resin housing is molded.

5. A large current fuse according to any one of claims 1 or 2, wherein a plurality of fins are formed on said resin housing at least at areas on which said resin housing is molded on said first conductive plate and said second conductive plate.

* * * * *